US011367958B2

(12) United States Patent
Tuau et al.

(10) Patent No.: US 11,367,958 B2
(45) Date of Patent: Jun. 21, 2022

(54) MULTI-BAND RADIO-FREQUENCY (RF) ANTENNA SYSTEM

(71) Applicant: Nokia Shanghai Bell Co., Ltd., Shanghai (CN)

(72) Inventors: Denis Tuau, Trignac (FR); Yoann Letestu, Sainte-Anne sur Brivet (FR)

(73) Assignee: Nokia Shanghai Bell Co., Ltd, Shanghai (CN)

( * ) Notice: Subject to any disclaimer, the term of this patent is extended or adjusted under 35 U.S.C. 154(b) by 0 days.

(21) Appl. No.: 17/050,591

(22) PCT Filed: Apr. 26, 2019

(86) PCT No.: PCT/CN2019/084676
§ 371 (c)(1),
(2) Date: Oct. 26, 2020

(87) PCT Pub. No.: WO2019/206304
PCT Pub. Date: Oct. 31, 2019

(65) Prior Publication Data

US 2021/0126376 A1 Apr. 29, 2021

(30) Foreign Application Priority Data

Apr. 27, 2018 (EP) ..... 18169977

(51) Int. Cl.
*H01Q 15/16* (2006.01)
*H01Q 5/47* (2015.01)
(Continued)

(52) U.S. Cl.
CPC ..... *H01Q 5/47* (2015.01); *H01Q 13/02* (2013.01); *H01Q 13/025* (2013.01);
(Continued)

(58) Field of Classification Search
CPC ..... H01Q 5/47; H01Q 13/025; H01Q 19/19; H01Q 19/134
See application file for complete search history.

(56) References Cited

U.S. PATENT DOCUMENTS 4,827,277 A * 5/1989 Becker ..... H01Q 19/19 343/781 P
6,081,170 A * 6/2000 Enokuma ..... H01Q 5/47 333/134
(Continued)

FOREIGN PATENT DOCUMENTS

CN 2433740 Y 6/2001
CN 101170220 A 4/2008
(Continued)

OTHER PUBLICATIONS

International Search Report for PCT/CN2019/084676 dated Jul. 17, 2019.

*Primary Examiner* — Ab Salam Alkassim, Jr.
(74) *Attorney, Agent, or Firm* — Fay Sharpe LLP

(57) ABSTRACT

An apparatus, for example a multi-band radio frequency antenna system, comprising: a primary reflector, for example a parabolic reflector; and a near-field feed arrangement comprising: a multi-band waveguide feed comprising a first waveguide feed for a first frequency band and a second waveguide feed for a second frequency band separate to the first frequency band, wherein the first waveguide feed and the second waveguide feed are co-axial and have, respectively, a first aperture and a second aperture; and a splashplate located within the near-field of the first waveguide feed, located within the near field of the second waveguide feed and configured as a feed for the primary reflector.

15 Claims, 4 Drawing Sheets

(51) Int. Cl.
*H01Q 13/02* (2006.01)
*H01Q 19/19* (2006.01)
*H01Q 19/13* (2006.01)

(52) U.S. Cl.
CPC ..... *H01Q 15/165* (2013.01); *H01Q 19/134* (2013.01); *H01Q 19/19* (2013.01)

(56) References Cited

U.S. PATENT DOCUMENTS 6,831,613 B1* 12/2004 Gothard ..... H01Q 13/0266 343/779
8,089,415 B1* 1/2012 West ..... H01Q 5/55 343/776
9,537,222 B2* 1/2017 Boutigny ..... H01Q 19/193
2004/0041737 A1* 3/2004 Gothard ..... H01Q 19/191 343/781 P
2004/0164920 A1 8/2004 Nilsson
2004/0257290 A1* 12/2004 Gothard ..... H01Q 19/19 343/781 CA
2005/0007288 A1* 1/2005 Tuau ..... H01Q 19/193 343/781 CA
2005/0083241 A1* 4/2005 Zarro ..... H01Q 5/47 343/786
2005/0088355 A1* 4/2005 Kralovec ..... H01Q 13/0208 343/781 P
2005/0099350 A1* 5/2005 Gothard ..... H01Q 19/193 343/781 CA
2005/0099351 A1* 5/2005 Gothard ..... H01Q 15/0033 343/781 CA
2006/0082513 A1* 4/2006 Kralovec ..... H01Q 19/19 343/781 CA
2013/0057445 A1* 3/2013 Simms ..... H01Q 1/42 343/781 P
2013/0300621 A1* 11/2013 Brandau ..... H01Q 15/16 343/781 CA
2014/0218256 A1* 8/2014 Tanabe ..... H01Q 19/13 343/837
2014/0247191 A1* 9/2014 Mahon ..... H01Q 19/191 343/781 CA
2014/0292605 A1* 10/2014 Roberts ..... H01Q 13/20 343/781 CA
2014/0368408 A1* 12/2014 Tuau ..... H01Q 19/134 343/914
2015/0084821 A1* 3/2015 Rao ..... H01Q 19/19 343/781 CA
2015/0357713 A1 12/2015 Griffith et al.
2019/0207321 A1* 7/2019 Hollenbeck ..... H01Q 5/47
2019/0288394 A1* 9/2019 Saraf ..... H01Q 5/392
2020/0280135 A1* 9/2020 Biancotto ..... H01Q 19/134
2020/0313296 A1* 10/2020 Mitchelson ..... H01P 1/207

FOREIGN PATENT DOCUMENTS

CN 102394374 A 3/2012
CN 105261839 A 1/2016
CN 109643855 A 4/2019
EP 2 565 984 A1 3/2013
WO WO 99/10950 3/1999

* cited by examiner

MULTI-BAND RADIO-FREQUENCY (RF) ANTENNA SYSTEM

TECHNOLOGICAL FIELD

Embodiments of the present disclosure relate to a multi-band radio-frequency (RF) antenna system. Some examples relate to a dual backfire feed for a parabolic reflector antenna.

BACKGROUND

The introduction of 5G, Internet of Things and the Cloud will lead to a tremendous increase in the volume of data traffic. In order to cope and deliver the required capacity, new concepts and approaches are needed.

BRIEF SUMMARY

According to various, but not necessarily all, embodiments there is provided an apparatus comprising: a primary reflector; and a near-field feed arrangement comprising: a multi-band waveguide feed comprising a first waveguide feed for a first frequency band and a second waveguide feed for a second frequency band separate to the first frequency band, wherein the first waveguide feed and the second waveguide feed are co-axial and have, respectively, a first aperture and a second aperture; and a splashplate located within the near-field of the first waveguide feed, located within the near field of the second waveguide feed and configured as a feed for the primary reflector.

In some but not necessarily all examples, the splashplate is separated from the first aperture of the first waveguide feed by a distance less than the Fraunhofer distance for the lowest frequency of the first frequency band.

In some but not necessarily all examples, the splashplate is separated from the second aperture of the second waveguide feed by a distance less than the Fraunhofer distance for the lowest frequency of the second frequency band.

In some but not necessarily all examples, the splashplate is separated from the first aperture of the first waveguide feed by a distance less than twice a wavelength in free-space associated with a lowest frequency of the first frequency band.

In some but not necessarily all examples, the splashplate is separated from the second aperture of the second waveguide feed by a distance less than twice a wavelength in free-space associated with a lowest frequency of the second frequency band In some but not necessarily all examples, the first frequency band is higher than the second frequency band, and the first aperture is closer to the splashplate than the second aperture.

In some but not necessarily all examples, the apparatus is configured to operate at least with a second frequency band less than 50 GHz, for example between 4 to 42 GHz, such as 13 GHz or 38 GHz, and a first frequency band greater than 50 GHz, for example 60 GHz or 80 GHz. However, in other examples, the apparatus is configured to operate at least with the second frequency band and the first frequency band less than 50 GHz, for example 13 GHz and 38 GHz respectively.

In some but not necessarily all examples, the splashplate defines a continuous surface that comprises a first portion configured as a feed for the first frequency band and a second portion configured as a feed for the second frequency band, wherein the first portion is located within the near-field of the first waveguide feed and the second portion is located within the near field of the second waveguide feed.

In some but not necessarily all examples, the first portion is rotationally symmetric about a boresight axis and the second portion is rotationally symmetric about the boresight axis, wherein the first portion comprises one or more concave surfaces each of which is rotationally symmetric about the boresight axis and wherein the second portion comprises one or more concave surfaces each of which is rotationally symmetric about the boresight axis.

In some but not necessarily all examples, the multi-band waveguide feed is surrounded by an adjacent skirt that is rotationally symmetric about a boresight axis and comprises, when viewed in cross-section through the boresight axis a tilted surface that recedes from the splashplate as it extends outwardly from the boresight axis.

In some but not necessarily all examples, the multi-band waveguide feed is surrounded by a peripheral skirt that is rotationally symmetric about a boresight axis. The peripheral skirt may comprise a surface that:

(i) comprises one or more notches that are rotationally symmetric about the boresight axis and/or (ii) is a tilted surface that extends inwardly towards the boresight axis as it recedes from the splashplate and/or (iii) comprises added material for absorbing electromagnetic energy in at least the first and second frequency bands.

In some but not necessarily all examples, one or both of the first aperture and the second aperture are tapered horn apertures.

In some but not necessarily all examples, the first waveguide feed and the second waveguide feed are configured to have coincident phase centers for the first frequency band and the second frequency band.

In some but not necessarily all examples, the phase center for the first frequency band and the phase center for the second frequency band is a ring coincident with a focal ring of the primary reflector.

In some but not necessarily all examples, a network element comprising the apparatus and is configured to use the apparatus for point to point wireless communication with another network element.

In some but not necessarily all examples, a cell tower of a cellular communications network comprising the apparatus and is configured to use the apparatus for backhaul communication with a core network.

According to various, but not necessarily all, embodiments there is provided examples as claimed in the appended claims.

DEFINITIONS

'a primary reflector' is a reflector of electromagnetic energy. It is primary in that it determines a primary direction of gain.

'a near-field feed arrangement' is an arrangement of components coupled in the near-field that operates as a feed for the primary reflector. Its components may be coupled exclusively in the near-field.

'a multi-band waveguide feed' is a component of the near-field feed arrangement and is a waveguide feed that operates in multiple frequency bands.

'a frequency band' is a contiguous range of frequencies.

'a waveguide feed' is a waveguide that feeds. A waveguide is a structure that guides waves without significant loss.

'aperture' is an open-end of a waveguide.

'splashplate' (or splash plate or splash-plate) is an electromagnetic coupling element.

It is structurally similar to a reflector but is positioned in the near-field of the multi-band waveguide.

'near-field' is the volume where the dominant E (electric) and H (magnetic) field strengths decrease more rapidly than inversely with distance from the source. It may alternatively be defined as within the Fraunhofer distance from the source or within one or two wavelengths of the source.

'feed' is a component of collection of components that feeds radio waves to or from another component.

BRIEF DESCRIPTION

Some example embodiments will now be described with reference to the accompanying drawings in which.

DETAILED DESCRIPTION

Figure 1:
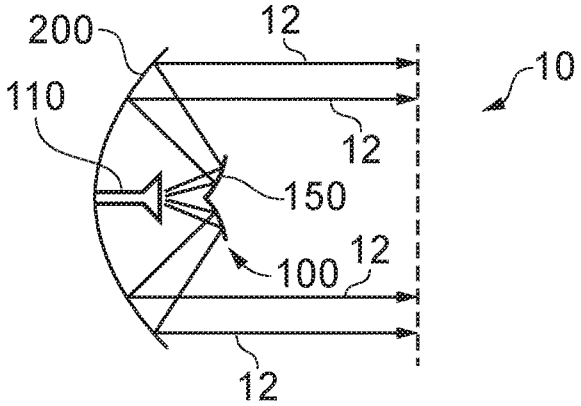
FIG. 1 shows an example embodiment of the subject matter described herein.

FIG. 1 illustrates an example of an apparatus 10 comprising: a primary reflector 200; and a near-field feed arrangement 100 that is configured as a feed for the primary reflector 200.

The near-field arrangement 100 comprises a multi-band waveguide feed 110 and a splashplate 150 located within the near-field of the multi-band waveguide feed 110. The splashplate 150 is configured as a feed for the primary reflector 200.

Electromagnetic energy 12, at the different frequency bands, can be efficiently coupled from the multi-band waveguide feed 110, via the splashplate 150, to the primary reflector 200. Electromagnetic energy, at the different frequency bands, can be efficiently coupled from the primary reflector 200, via the splashplate 150, to the multi-band waveguide feed 110.

The apparatus 10 is a compact, multi-band radio-frequency (RF) antenna system.

Figure 2:
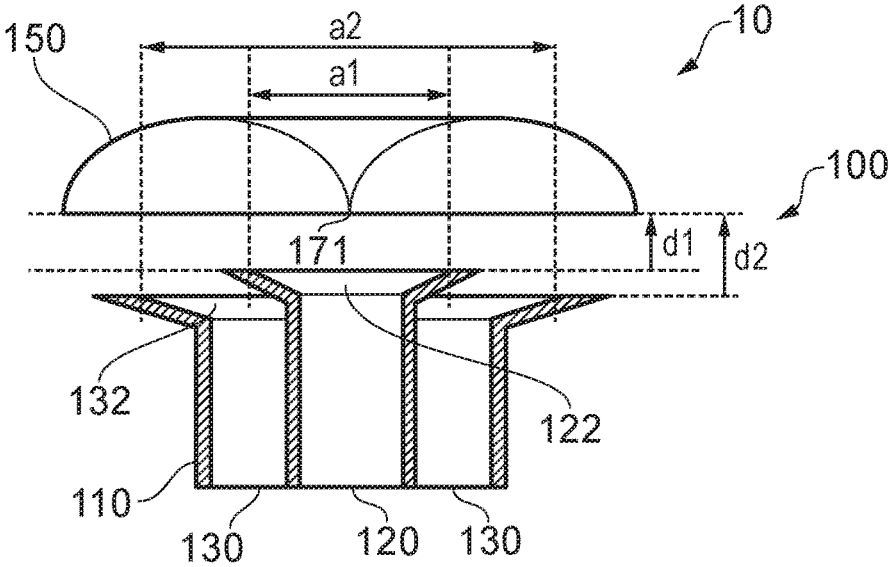
FIG. 2 shows another example embodiment of the subject matter described herein.
Figure 3:
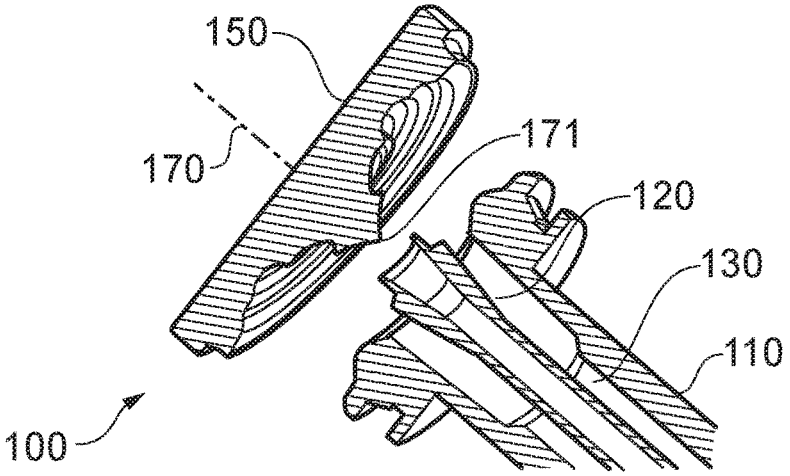
FIG. 3 shows an example embodiment of the subject matter described herein.

FIGS. 2 and 3 illustrates other examples of the apparatus 10. In these examples the multi-band waveguide feed 110 is illustrated in more detail. The multi-band waveguide feed 110 comprises a first waveguide feed 120 for a first frequency band and a second waveguide feed 130 for a second frequency band separate to the first frequency band.

The first waveguide feed 120 and the second waveguide feed 130 are co-axial. The first waveguide feed 120 has a first aperture 122 and the second waveguide feed 130 has a second aperture 132.

The splashplate 150 is located within the near-field of the first waveguide feed 120 and is located within the near field of the second waveguide feed 130.

The first waveguide feed 120 and the second waveguide feed 130 are configured in a nested, backfire arrangement. The multi-band waveguide feed 110 operates as a near field backfire primary feed.

The primary reflector 200 may be a parabolic reflector, for example a primary shaped parabolic reflector. It should be appreciated that the term 'parabolic' includes within its scope exactly parabolic and substantially parabolic. The primary reflector 200 may be 'shaped' so that it deviates slightly from a perfect parabola.

FIG. 2 illustrates that the splashplate 150 is separated from the first aperture 122 of the first waveguide feed 120 by a distance d1 and the splashplate 150 is separated from the second aperture 132 of the second waveguide feed 130 by a distance d2.

In this example, d1 is less than the Fraunhofer distance for the lowest frequency of the first frequency band, and d2 is less than the Fraunhofer distance for the lowest frequency of the second frequency band.

Also in this example, d1 is less than twice a wavelength in free-space associated with a lowest frequency (highest wavelength, shortest Fraunhofer distance) of the first frequency band and d2 is less than twice a wavelength in free-space associated with a lowest frequency (highest wavelength, shortest Fraunhofer distance) of the second frequency band In some examples, the apparatus 10 may be made even more compact by having dielectric material between the splashplate 150 and waveguide feeds 120, 130 of the multi-band waveguide feed 110. The minimum separation for near-field operation is inversely proportional to $\sqrt{\varepsilon_r}$, where $\varepsilon_r$ is the dielectric constant of the dielectric material.

In the example illustrated, the first frequency band is higher than the second frequency band, and the first aperture 122 is closer to the splashplate 150 than the second aperture 132.

The first aperture 122 is a central aperture and the second aperture 132 is a larger, coaxial aperture.

For example, in some but not necessarily all example, the second frequency band is less than 20 GHz and the first frequency band is greater than 60 GHz. For example, the second frequency band could cover, at minimum, the frequencies 13/15 GHz and the first frequency band could cover the frequencies 80 GHz. In other examples, the second frequency band is within a range 3 to 30 GHz and the first frequency range is above 40 GHz. The center frequency of the first frequency band can be more than twice the center frequency of the second frequency band The splashplate has a central vertex 171 aligned with a boresight axis 170. This is the portion of the splashplate 150 closest to the multi-band waveguide feed 110. The distance d1 is measured between a plane of the first aperture 122 perpendicular to the boresight axis 170 and a parallel plane through the vertex 171. The distance d2 is measured between a plane of the second aperture 132 perpendicular to the boresight axis 170 and a parallel plane through the vertex 171.

In this example, the first aperture 122 is circular and has a diameter a1 and the second aperture is circular and has a diameter a2.

The distance d1 between the vertex 171 of the splashplate 150 and the first aperture 122 of the multi-band waveguide feed 110 is less than the Fraunhofer distances $(2.(a1)^2/\lambda 1$ for the first aperture, where $\lambda 1$ is the longest wavelength for the first frequency band).

The distance d2 between the vertex 171 of the splashplate 150 and the second aperture 132 of the multi-band waveguide feed 110 is less than the Fraunhofer distances $(2.(a2)^2/\lambda 1$ for the second aperture, where $\lambda 1$ is the longest wavelength for the second frequency band).

For instance, the distance d1 and d2 for the dual band 80 GHz and 22 GHz are 5.4 mm and 2.7 mm respectively, where the diameter a1 and a2 are equal to 5.4 mm and 20.8 mm. The distance d1 is lower than 15.5 mm, the near-field limit at 80 GHz and the distance d2 is lower than 63 mm, the near-field limit at 22 GHz. Moreover, the distances are lower than one wavelength in each frequency band.

Figure 4A:
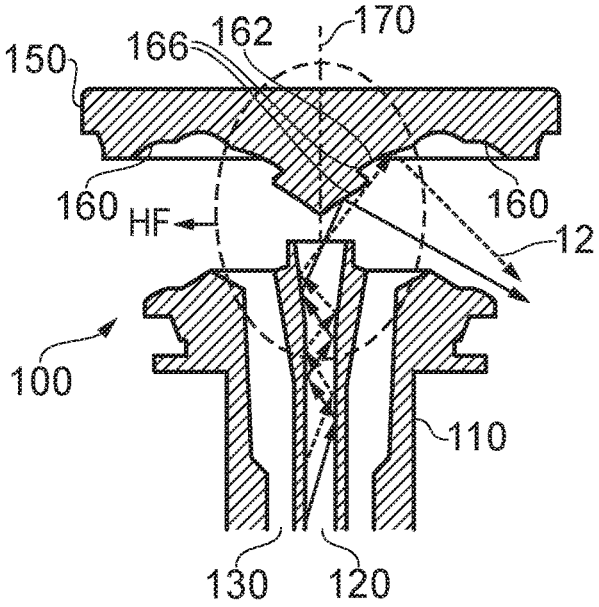
FIG. 4A shows another example embodiment of the subject matter described herein.
Figure 4B:
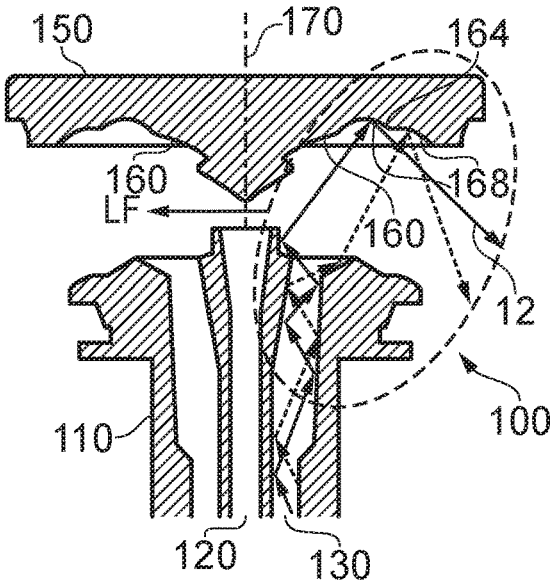
FIG. 4B shows an example embodiment of the subject matter described herein.

Aspects of the splashplate 150 can be appreciated from FIGS. 4A and 4B which illustrate the same near-field feed arrangement 100. FIG. 4A schematically illustrates transmission of signals in the first frequency band via the first waveguide feed 120. FIG. 4B schematically illustrates transmission of signals in the second frequency band via the second waveguide feed 130. While only transmission of signals is illustrated, it should be understood that according to the theory of reciprocity, the near-field feed arrangement 100 will operate similarly for reception of signals 12.

The splashplate 150 is unitary and defines a continuous surface 160. The continuous surface 160 comprises a first portion 162 configured as a feed for the first frequency band and a second portion 164 configured as a feed for the second frequency band.

All of the first portion 162 is located within the near-field of the first waveguide feed 120 and all of the second portion 164 is located within the near field of the second waveguide feed 130. The first portion 162 of splashplate 150 is separated from the first aperture 122 of the first waveguide feed 120 by a distance less than the Fraunhofer distance for the lowest frequency of the first frequency band. The second portion 164 of the splashplate 150 is separated from the second aperture 132 of the second waveguide feed 130 by a distance less than the Fraunhofer distance for the lowest frequency of the second frequency band. The first portion 162 of the splashplate 150 is separated from the first aperture 122 of the first waveguide feed 120 by a distance less than twice the wavelength in free-space associated with a lowest frequency of the first frequency band. The second portion 164 of the splashplate 150 is separated from the second aperture 132 of the second waveguide feed 130 by a distance less than twice the wavelength in free-space associated with a lowest frequency of the second frequency band.

The first portion 162 is rotationally symmetric about the boresight axis 170 and the second portion 164 is rotationally symmetric about the boresight axis 170.

The first portion 162 comprises one or more curved surfaces 166 each of which is rotationally symmetric about the boresight axis 170. The second portion 164 comprises one or more curved surfaces 168 each of which is rotationally symmetric about the boresight axis 170.

Referring to FIG. 4A, the first portion 162 comprises multiple concave surfaces 166 each of which is rotationally symmetric about the boresight axis 170. The first portion 162, in radial cross-section through the boresight axis 170, comprises two substantially concave surfaces 166 that are axially and radially off-set. The most radially distant surface 166 is also the furthest from the aperture 122 in the direction of the boresight axis 170.

Referring to FIG. 4B, the second portion 164 comprises one or more concave surfaces 168 each of which is rotationally symmetric about the boresight axis 170. The second portion 164, in radial cross-section through the boresight axis 170, comprises two substantially concave surfaces 168 that are axially and radially off-set. The most radially distant surface 168 is also the closest to the aperture 124 in the direction of the boresight axis 170.

Figure 5A:
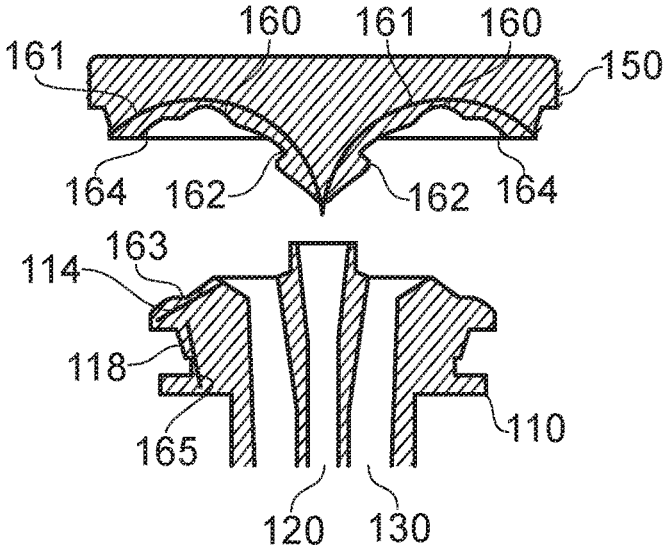
FIG. 5A shows another example embodiment of the subject matter described herein.

Referring to FIG. 5A the first portion 162 and the second portion 164 together form a continuous surface 160 having, radial cross-section through the axis, a shape 161 of a modified ellipsoid.

Figure 5B:
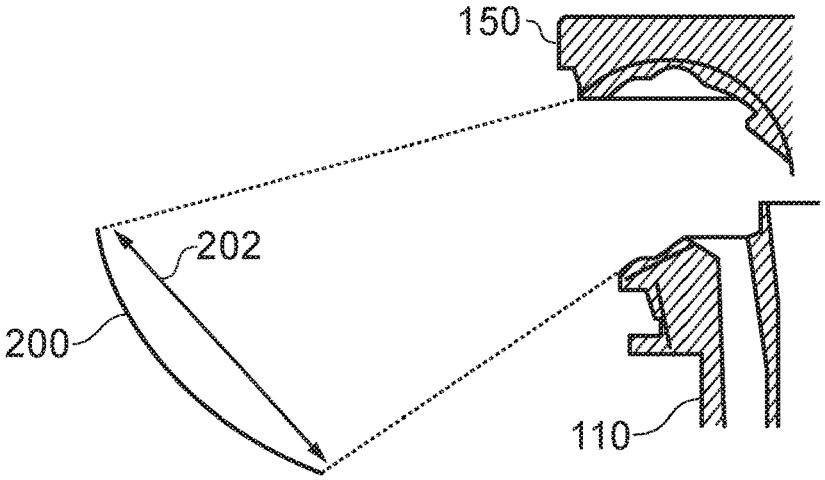
FIG. 5B shows an example embodiment of the subject matter described herein.

FIG. 5B illustrates how the splashplate 150 enables optimized illumination of a particular area 202 of the primary reflector 200.

The shape of the various surfaces 160 of the splashplate 150 are tailored to optimize the illumination efficiency in the primary reflector 200.

The splashplate 150 may be supported by a strut, preferably made of dielectric material, or by a shaped solid or foam dielectric cone.

The splashplate 150 may comprise dielectric and consequently can have different refractive properties at different frequency bands.

Figure 6A:
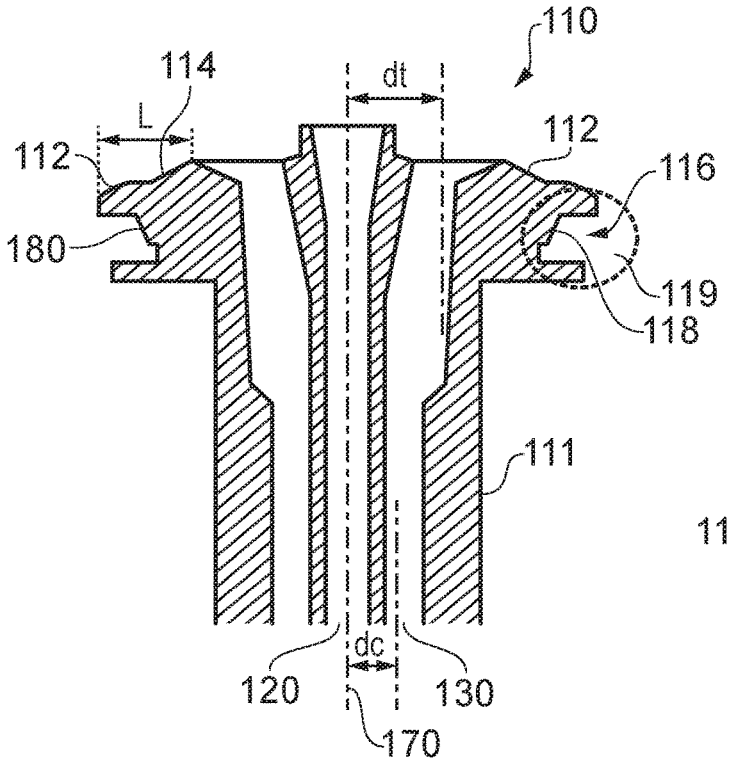
FIG. 6A shows another example embodiment of the subject matter described herein.
Figure 6B:
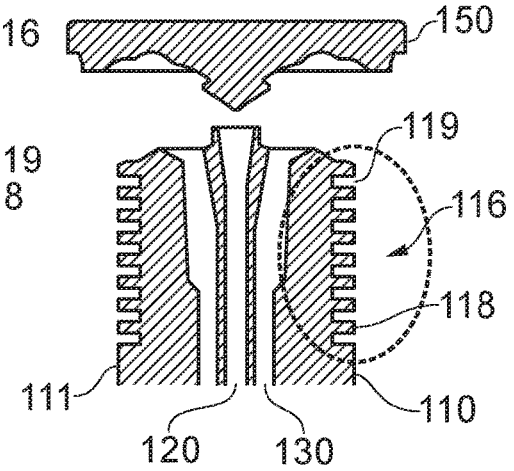
FIG. 6B shows an example embodiment of the subject matter described herein.

FIGS. 6A and 6B illustrate aspects of an exterior surface of a housing 111 of the multi-band waveguide feed 110

The structure of the housing 111 of the multi-band waveguide feed 110 is configured not only to house the first waveguide feed 120 and the second waveguide feed 130 but to provide optimised exterior surfaces.

The multi-band waveguide feed 110 is surrounded by an adjacent skirt 112 as part of the housing 111. The adjacent skirt 112 is rotationally symmetric about a boresight axis 170 and comprises, when viewed in cross-section through the boresight axis a tilted surface 114 that recedes from the splashplate plate 150 as it extends outwardly radially from the boresight axis 170. The tilt 163 of the surface 114 is, for example, labelled in FIG. 5A.

The adjacent skirt 112 extends radially outwardly from the edge of the aperture 132 for a length L. This length L may be modified as a design parameter.

The adjacent skirt 112 is at its apex adjacent the edge of the aperture 132, it then slopes outwardly and downwardly (away from the splashplate 15), then slopes outwardly but less downwardly and again slopes outwardly and downwardly. This gives it a slope-flat-slope profile.

The tilt may be varied to control E-field in an illumination area of the primary reflector 200.

The length L may be varied to shape the illumination of the feed (coupling with the splashback 150 and the apertures 122, 132).

The multi-band waveguide feed 110 is also surrounded by a peripheral skirt 116 that is rotationally symmetric about a boresight axis 170. The peripheral skirt 116 comprises a surface 118.

In some but not necessarily all examples, the surface 118 comprises one or more notches 119 that are rotationally symmetric about the boresight axis 170—forming a circular groove. In FIG. 6A there is a single notch 119 and in FIG. 6B there are multiple notches 119 of the same size separated, at regular intervals, in the direction of the boresight axis 170. The grooves remove (or limit) back radiation parallel to the axis 170. Other types of corrugation can be used to remove the back radiation.

In some but not necessarily all examples, the surface 118 is a tilted surface 118 that extends inwardly towards the boresight axis as it recedes from the splashplate plate. The tilt 165 of the surface 118 is labelled in FIG. 5A.

In some but not necessarily all examples, the surface 118 comprises added material 180 for absorbing electromagnetic energy in at least the first and second frequency bands. This reduces the backfire radiation parallel to the axis 170.

In the preceding examples, one or both of the first aperture 122 and the second aperture 132 can have a flared profile. They can form a tapered horn aperture. Different flared profiles are illustrated in FIGS. 2 and in FIGS. 3 to 6B.

For the high frequency band, e.g. 80 GHz, the tapered horn aperture 122 enables a narrow and symmetrical radiation beam, reducing the illumination area and limiting coupling with the second aperture 132 of the low frequency band.

For the low frequency band, e.g. 23 GHz, controlling a shape of the tapered horn aperture 132 enables tuning of a phase center location and also reduction of the coupling with the first aperture 122.

Referring to FIG. 6A, the distance between the first circular waveguide 120 and the second coaxial waveguide 130 dt(mm) is obtained by: $1.8*dc<dt<2.2*dc$, where dc is the radial distance between the first circular waveguide 120 and the second coaxial circular waveguide 130 within the waveguides 120, 130 and dt is the radial distance between the first circular waveguide 120 and the second coaxial circular waveguide 130 at their apertures 122, 132.

In both tapered horn apertures 122, 132, the aperture diameter, flare angle and aperture length are parameters to control the phase center and the radiation pattern performances of the primary reflector 200.

In some but not necessarily all examples, the first waveguide feed 120 and the second waveguide feed 130 are configured to have coincident phase centers 190 for the first frequency band and the second frequency band. The phase center 190 is the apparent point of origin of radiation.

Figure 7:
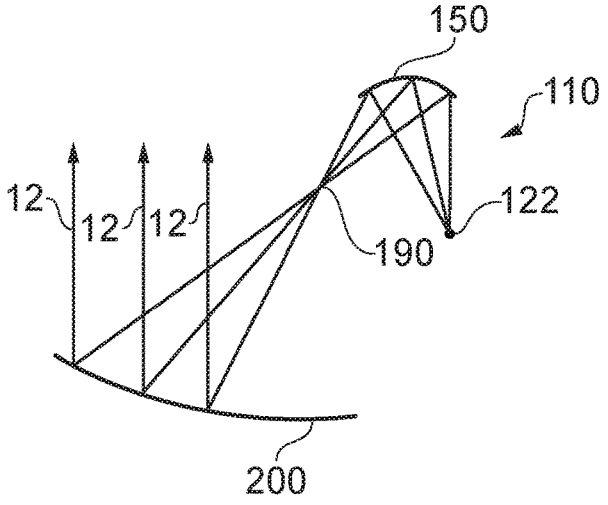
FIG. 7 shows another example embodiment of the subject matter described herein.

FIG. 7 illustrates a phase center 190 for radiation 12 emitted by the first aperture 122 of the multi-band waveguide 110.

Referring back to FIGS. 6A, 6B, the shapes of the splashplate 150 and the two waveguide apertures—circular aperture 122 and coaxial aperture 132, operating in the near field, are controlled to obtain a phase center around a ring coincident with the focal ring of the primary reflector 200 in order to obtain the best antenna radiation performances in both frequency bands. The phase center is on a ring around the axis 170 and is coincident with a ring focus of the primary reflector 200. The optimum primary reflector 200 is a ring-focus paraboloid with the ring focus coinciding with the ring-shaped phase center.

The surfaces 160, 166, 168, 114, 118 of the multi-band waveguide feed 110, splashplate 150 and the primary reflector 200 can be designed for optimal performance. This may be achieved by using commercially available numerical modelling solutions. They map a pattern of the feed radiation into a uniform illumination of the primary reflector 200 and enable variation of design parameters to maximize the gain and reduce phase error.

Figure 8:
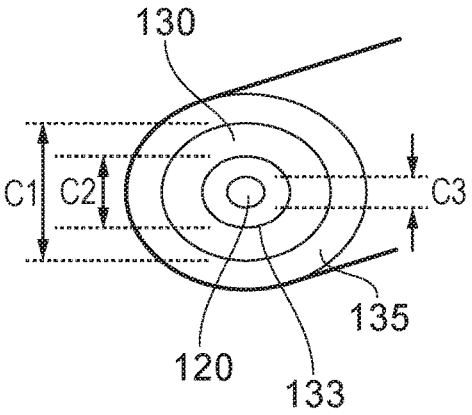
FIG. 8 shows an example embodiment of the subject matter described herein.

FIG. 8 illustrates dimensions of the coaxial first and second waveguide feeds 120, 130.

The first and second waveguide feeds 120, 130 may be configured to support TE11 mode, for example.

The first waveguide feed 120 is an inner feed and second waveguide feed 130 is an outer feed that surrounds the inner feed.

The first waveguide feed 120 is a circular waveguide and the second waveguide feed 130 is a coaxial wave guide comprising an inner conductive core 133 provided by the first feed 120 and an outer conductive shield 135.

The first waveguide feed 120 and the second waveguide feed 130 are two nested backfire feeds operating in two distinct frequency bands.

The first waveguide feed 120 can be an open-ended or flared horn circular waveguide excited by a TE11 circular mode for the high frequency band.

The second waveguide feed 130 can be an open-ended or flared horn coaxial waveguide excited with a coaxial TE11 mode for the low frequency band.

The outer pipe diameter of the circular waveguide of the high frequency band is used as the inner conductor of the coaxial waveguide.

In FIG. 8, c1 is the diameter of the shield 135 and c2 the inner diameter of the core 133. These values are selected in order to properly propagate the TE11 coaxial waveguide mode.

For a solution operating in the frequency band 21.2-23.6 GHz for the low frequency band of a dual band solution, the inner diameter c2 and the outer diameter c1 are respectively equal to 5.20 mm and 10.32 mm.

In FIG. 8, the diameter c3 is the internal pipe diameter of the inner conductor 133 of the coaxial waveguide and is selected to properly propagate the TE11 circular waveguide mode along the first waveguide feed 120. For a solution operating in the frequency band 71-86 GHz, the diameter c3 is equal to 3.12 mm.

Figure 9:
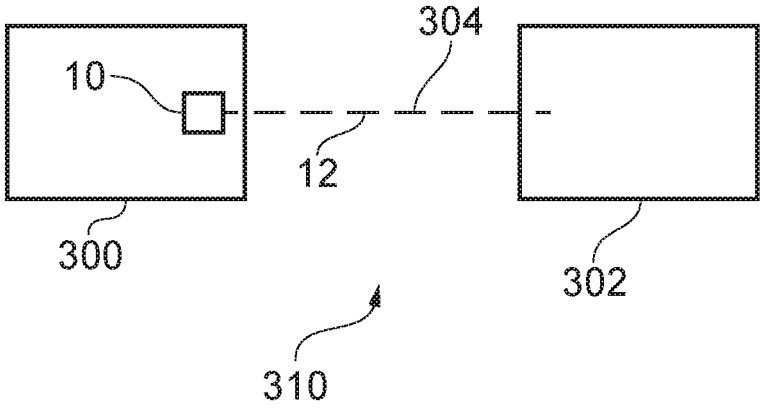
FIG. 9 shows another example embodiment of the subject matter described herein.

FIG. 9 illustrates an example of a network element 300 comprising the apparatus 10. The network element 300 is configured to use the apparatus 10 for point to point wireless communication 304 with another network element 302.

In some but not necessarily all examples, the network element 300 is a cell tower of a cellular communications network 310, and the other network element 302 represents a core network. The cell tower 300 is configured to use the apparatus 10 for backhaul communication with the core network.

The compact multi-band band antenna 10 reduces the tower leasing cost, installation time and for lightening the tower structure as only one reflector 200 is required for multiple frequency bands.

In some but not necessarily all examples the network element 300 is configured for carrier aggregation. The two separated frequency bands, the first frequency band and the second frequency band, are used for one radio link.

The apparatus 10 can be used for transmitting, for receiving and for transmitting and receiving. It finds application in point-to-point communications, a terrestrial data link, line of sight communications.

The communication distance may be 10 m to 100's km. The data rate of communication may be greater than 1 Gbs or greater than 10 Gbps.

The first and second frequency bands may be separated by several GHz.

The first frequency band may be the 80 GHz or the 60 GHz frequency band and the second frequency band may be the 22 GHz frequency band or a frequency band between 6 GHz and 42 GHz.

The first frequency band may be within the extremely high frequency range 20-300 GHz (10-1 mm wavelength) .The second frequency band may be within the super high frequency range 3-30 GHz (10-1 cm wavelength)

Where a structural feature has been described, it may be replaced by means for performing one or more of the functions of the structural feature whether that function or those functions are explicitly or implicitly described.

In some but not necessarily all examples, the apparatus 10 is configured to communicate data from the network element 300 with or without local storage of the data in a memory at the network element 300 and with or without local processing of the data by circuitry or processors at the network element 300.

The data may be stored in processed or unprocessed format remotely at one or more devices. The data may be stored in the Cloud.

The data may be processed remotely at one or more devices. The data may be partially processed locally and partially processed remotely at one or more devices.

The apparatus network element 300 may be part of the Internet of Things forming part of a larger, distributed network.

The processing of the data, whether local or remote, may involve artificial intelligence or machine learning algorithms. The data may, for example, be used as learning input to train a machine learning network or may be used as a query input to a machine learning network, which provides a response. The machine learning network may for example use linear regression, logistic regression, vector support machines or an acyclic machine learning network such as a single or multi hidden layer neural network.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning. That is any reference to X comprising a/the Y indicates that X may comprise only one Y or may comprise more than one Y uncles the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature (or combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

The invention claimed is:

1. An apparatus comprising:

a primary reflector; and a near-field feed arrangement comprising:

a multi-band waveguide feed comprising a first waveguide feed for a first frequency band and a second waveguide feed for a second frequency band separate to the first frequency band, wherein the first waveguide feed and the second waveguide feed are co-axial and have, respectively, a first aperture and a second aperture, and wherein an adjacent skirt extends outwardly from the second aperture; and a splashplate located within the near-field of the first waveguide feed and located within the near field of the second waveguide feed, wherein the splashplate is configured as a feed for the primary reflector and defines a continuous surface that comprises a first portion comprising one or more concave surfaces and being configured as a feed for the first frequency band and a second portion comprising one or more concave surfaces and being configured as a feed for the second frequency band, and wherein the first aperture is closer to the splashplate than the second aperture.

2. An apparatus as claimed in claim 1, wherein the splashplate is separated from the first aperture of the first waveguide feed by a distance less than the Fraunhofer distance for the lowest frequency of the first frequency band, and the splashplate is separated from the second aperture of the second waveguide feed by a distance less than the Fraunhofer distance for the lowest frequency of the second frequency band.

3. An apparatus as claimed in claim 1, wherein the splashplate is separated from the first aperture of the first waveguide feed by a distance less than twice a wavelength in free-space associated with a lowest frequency of the first frequency band, and the splashplate is separated from the second aperture of the second waveguide feed by a distance less than twice a wavelength in free-space associated with a lowest frequency of the second frequency band.

4. An apparatus as claimed in claim 1 wherein the first frequency band is higher than the second frequency band.

5. An apparatus as claimed in claim 1 configured to operate at least with a second frequency band less than 50 GHz and a first frequency band greater than 50 GHz.

6. An apparatus as claimed in claim 1 wherein the first portion is located within the near-field of the first waveguide feed and the second portion is located within the near field of the second waveguide feed.

7. An apparatus as claimed in claim 6 wherein the first portion is rotationally symmetric about a boresight axis and the second portion is rotationally symmetric about the boresight axis, wherein the one or more concave surfaces of the first portion are each rotationally symmetric about the boresight axis and wherein the one or more concave surfaces of the second portion are each rotationally symmetric about the boresight axis.

8. An apparatus as claimed in claim 1 wherein the multi-band waveguide feed is surrounded by the adjacent skirt that is rotationally symmetric about a boresight axis and comprises, when viewed in cross-section through the boresight axis, a tilted surface that recedes from the splashplate as it extends outwardly from the boresight axis.

9. An apparatus as claimed in claim 1 wherein the multi-band waveguide feed is surrounded by a second skirt that is peripheral and rotationally symmetric about a boresight axis.

10. An apparatus as claimed in claim 9, wherein the peripheral skirt comprises a surface that:

(i) comprises one or more notches that are rotationally symmetric about the boresight axis and/or (ii) is a tilted surface that extends inwardly towards the boresight axis as it recedes from the splashplate and/or (iii) comprises added material for absorbing electromagnetic energy in at least the first and second frequency bands.

11. An apparatus as claimed in claim 1 wherein one or both of the first aperture and the second aperture are tapered horn apertures.

12. An apparatus as claimed in claim 1 wherein the first waveguide feed and the second waveguide feed are configured to have coincident phase centers for the first frequency band and the second frequency band.

13. An apparatus as claimed in claim 12 wherein the phase center for the first frequency band and the phase center for the second frequency band is a ring coincident with a focal ring of the primary reflector.

14. A network element comprising the apparatus as claimed in claim 1, configured to use the apparatus for point to point wireless communication with another network element.

15. A cell tower of a cellular communications network comprising the apparatus as claimed in claim 1, configured to use the apparatus for backhaul communication with a core network.

* * * * *